US008991354B2

(12) United States Patent
Lewis

(10) Patent No.: US 8,991,354 B2
(45) Date of Patent: Mar. 31, 2015

(54) ADVANCED ANGLED-CYLINDER PISTON DEVICE

(76) Inventor: Ronald Lewis, East Yaphank, NY (US)

( * ) Notice: Subject to any disclaimer, the term of this patent is extended or adjusted under 35 U.S.C. 154(b) by 669 days.

(21) Appl. No.: 12/802,317

(22) Filed: Jun. 5, 2010

(65) Prior Publication Data

US 2011/0005489 A1 Jan. 13, 2011

Related U.S. Application Data

(60) Provisional application No. 61/217,858, filed on Jun. 6, 2009, provisional application No. 61/271,522, filed on Jul. 22, 2009, provisional application No. 61/271,523, filed on Jul. 22, 2009, provisional application No. 61/273,363, filed on Aug. 3, 2009, provisional application No. 61/340,083, filed on Mar. 12, 2010.

(51) Int. Cl.
*F02F 3/00* (2006.01)
*F02F 7/00* (2006.01)

(52) U.S. Cl.
CPC ..... *F02F 7/0019* (2013.01)
USPC ..... 123/193.1; 123/193.5

(58) Field of Classification Search
USPC ..... 123/193.1, 193.5
See application file for complete search history.

(56) References Cited

U.S. PATENT DOCUMENTS

| | | | | |
|---|---|---|---|---|
| 1,956,804 | A * | 5/1934 | Meyer | 123/197.4 |
| 4,338,892 | A * | 7/1982 | Harshberger | 123/53.5 |
| 4,759,323 | A * | 7/1988 | August | 123/193.6 |
| 5,816,201 | A * | 10/1998 | Garvin | 123/53.1 |
| 6,612,281 | B1 * | 9/2003 | Martin | 123/197.4 |
| 6,851,401 | B2 * | 2/2005 | Nystrom | 123/53.1 |
| 6,952,923 | B2 * | 10/2005 | Branyon et al. | 60/597 |
| 6,986,329 | B2 * | 1/2006 | Scuderi et al. | 123/70 R |
| 2003/0121490 | A1 * | 7/2003 | Hori et al. | 123/196 R |
| 2004/0154579 | A1 * | 8/2004 | Montgomery et al. | 123/276 |
| 2005/0139403 | A1 * | 6/2005 | Gokan et al. | 180/68.4 |
| 2006/0231164 | A1 * | 10/2006 | Ishida et al. | 148/206 |

* cited by examiner

*Primary Examiner* — Marguerite McMahon
*Assistant Examiner* — James Kim

(57) ABSTRACT

An advanced angled cylinder piston engine, pump, or compressor design. A method to determine optimum cylinder(s) orientation to achieve maximum torque. A method to determine proper cylinder(s) orientation achievable based on crankshaft and connecting rod dimensions. A cylinder insert sleeve, and a piston provide clearance for free operation of a connecting rod. A compensating piston provides proper cylinder volume to maintain desired compression ratio. An oil passage provides additional lubrication to cylinder wall.

20 Claims, 9 Drawing Sheets

ADVANCED ANGLED-CYLINDER PISTON DEVICE

CROSS-REFERENCE TO RELATED APPLICATIONS

This application claims the benefit of provisional patent applications filed by the present inventor:

Application No. 61/217,858, filed 2009 Jun. 6, Confirmation No. 5343

Application No. 61/271,522, filed 2009 Jul. 22, Confirmation No. 3572

Application No. 61/271,523, filed 2009 Jul. 22, Confirmation No. 3755

Application No. 61/273,363, filed 2009 Aug. 3, Confirmation No. 7705

Application No. 61/340,083, filed 2010 Mar. 12, Confirmation No. 3185

BACKGROUND

Field

This application relates to piston-plus-crankshaft devices.

BACKGROUND

Prior Art

The following is a tabulation of some prior art that presently appears relevant:

| U.S. Patents | | |
|---|---|---|
| Pat. No. | Issue Date | Patentee |
| 6,058,901 | May 9, 2000 | Lee |
| 6,745,746 B1 | Jun. 8, 2004 | Ishii |
| 4,664,077 | May 12, 1987 | Kamimaru |
| 5,816,201 | Oct. 06, 1998 | Garvin |
| 6,827,057 | Dec. 07, 2004 | Dawson |
| 5,076,220 | Dec. 31, 1991 | Evans, et al |
| 6,612,281 B1 | Oct. 2, 2003 | Martin |
| 4,708,096 | Nov. 24, 1987 | Mroz |
| 5,186,127 | Feb. 16, 1993 | Custico |
| 5,544,627 | Aug. 13, 1996 | Terdev, et al. |
| 4,702,151 | Oct. 27, 1987 | Munro, et al. |
| 7,543,556 B2 | Jun. 9, 2009 | Hees, et al. |

NONPATENT LITERATURE DOCUMENTS

Dr. Taj Elssir Hassan, "Theoretical Performance Comparison between Inline, Offset and Twin Crankshaft Internal Combustion Engines" (July 2008)

www.speedtalk.com/forum/Offset Bore & Crank Centerlines

The angled-cylinder or offset-crankshaft technique of designing internal and external combustion piston engines, piston pumps, and gas compressors is a technology that has been met with limited success. Designers of such devices have little guidance when employing this design technique to achieve results that produce a piston device that yields maximum performance gains, while requiring a minimum amount of modifications to traditional or existing engine, pump, or compressor designs.

Previous efforts to test and document the performance gains offered by the angled-cylinder or offset-crankshaft technology have employed tests that were conducted on internal combustion engines. Prototypes were constructed, and cylinder pressures, thermo-dynamics, and other characteristics of these engines were taken while in operation—for example discussion www.eng-tips.com/forum/thread7-201777, www.speedtalk.com/forum/offset bore & crank centerlines and U.S. Pat. No. 6,058,901 to Lee (2000). These tests mainly focused on some specific offset-crankshaft configuration targeted at some specific point in the combustion stroke. Additionally, new prototypes needed to be constructed to test configuration variables. This limited method of testing has produced misleading results.

Another method used to compare the performance between angled-cylinder or offset-crankshaft piston devices with conventionally configured piston devices focused on piston-to-sidewall frictions—for example "Reration between Crankshaft Offset and Piston Friction Loss. Amount of Offset and Engine Operating Condition"—Takiguchi Masaaki. Other efforts that have been employed are computer simulations and mathematical studies—for example www.camo-truck.net/rollins/piston-offset, Theoretical Performance Comparison between Inline, Offset, and Twin Crankshaft Internal Combustion Engines—Taj Elssir Hasaan. These methods of determining performance gains have also produced misleading results.

The orientation of the cylinder in such devices is extremely critical to performance. Some of the prior art related to the angled-cylinder or offset-crankshaft suggest values that are ineffective—for example U.S. Pat. No. 6,745,746 B1 to Ishii (2004) and U.S. Pat. No. 4,664,077 to Kamimaru (1987). Others specify designs that are too impractical to be viable—for example U.S. Pat. No. 5,816,201 to Garvin (1998) and U.S. Pat. No. 6,827,057 to Dawson (2004). Still other prior art and patents are very indeterminate in defining this relationship. Such terms as "approximately" and "about" are typically used—for example U.S. Pat. No. 6,612,281 B1 to Martin (2003) and U.S. Pat. No. 5,076,220 to Evans et al (1991). Additionally, if values are expressed in prior art at all, they fail to take into consideration other critical factors such as connecting rod-to-stroke ratios, which would render any expressed value effectively meaningless—for example U.S. Pat. No. 4,708,096 to Mroz (1987).

Designers of piston devices wishing to employ the angled-cylinder or offset-crankshaft technology have also been confronted with mechanical interferences and clearance limitations between the cylinder, connecting rod, and piston. Prior art that has addressed this issue specify connecting rod designs that alter the connecting rod centerline, and therefore would be prone to early failure—for example U.S. Pat. No. 5,186,127 to Cuatico (1993) and US patent to Terzlev (1996). Manufacturers of piston devices would be reluctant to adopt such designs. Other prior art addressing this problem suggest integrating modifications to the block casting—for example U.S. Pat. No. 4,708,096 to Mroz. (1987). As the close proximity of the piston components with the bottom of the cylinder are critical in these devices, this approach would prove challenging in the manufacturing process.

Other concerns encountered when designing a piston device employing the angled-cylinder or offset-crankshaft technology have no known directly related prior art.

Advantages

Accordingly designs and methods for providing designers of angled-cylinder piston devices with the ability to produce a device that benefits from the mechanical advantage inherent in the technology, while requiring as few modifications to existing or traditional designs as possible, thus making the angled-cylinder or offset-crankshaft technology viable.

DETAILED DESCRIPTION-FIGS. 1, 2, 12, and 13

First Embodiment

FIGS. 1, 2, 12, and 13 share all the same components. A cylinder head 21 could contain valves, spark plugs or other components that are not necessary for this disclosure, and therefore are not included. The cylinder 22 can be a bore in a block casting, a sleeve inserted into a bore, or an independent structure. A piston 23 and a connecting rod 26 are pivotally joined at a piston pivot 24. A piston pivot center axis 25, and a piston pivot horizontal centerline 40 are included for reference purposes. A crankshaft main journal 33, a throw 30, and a crankpin 28 represent the moving components of a crankshaft, or crankshaft assembly, and positioned at top-dead-center (TDC). A crankshaft main axis of rotation 34, and a crankpin center axis 29 are included for reference purposes. A stroke reference line 35 is included to show the travel of the crankpin center axis 29 as the crankshaft rotates 360° through an operating cycle. A length of connecting rod 27 and a length of throw 38 are included, as these dimensions are necessary for this disclosure. Both FIGS. 1, 2, 12, and 13 are drawings of what could be a single cylinder device, or one cylinder of a multiple cylinder device.

FIG. 1 is a drawing of an example of a piston designed using the angled-cylinder technique. A piston engine or motor employing this design technique basically begins with a traditional or existing design, and with the crankshaft 28,30,33 positioned to place the piston 23 at TDC (shown), a cylinder's centerline 37 orientation is rotated about the piston pivot center axis 25 location, thus orienting the cylinder's base in the direction of the crankpin 28 as the crankshaft's 28,30,33 operational rotation moves the crankpin 28 from TDC to bottom-dead-center (BDC). As illustrated in FIG. 12, in the case of a compressor or pump, the cylinder's centerline 37 orientation is rotated about the piston pivot center axis 25 location to orient the cylinder's 22 base in the direction of the crankpin 28 as the crankshaft's 28,30,33 operational rotation moves from BDC to TDC.

FIG. 2 is an example of a piston piston or motor designed using the offset-crankshaft or offset-cylinder technique. A piston engine or motor employing this design technique also begins with a traditional or an existing design, and the crankshaft's main axis of rotation 34 is offset in a perpendicular direction away from the cylinder's centerline 37, toward the direction of the crankpin 28 as the crankshaft's 28,30,33 operational rotation moves the crankpin 28 from BDC to TDC. As illustrated in FIG. 13, in the case of a compressor or pump, the crankshaft's main axis of rotation 34 is offset in a perpendicular direction from the cylinder's centerline 37, and toward the crankpin 28 as the crankshaft's 28,30,33 operational rotation moves the crankpin 28 from TDC to BDC.

If corrected for TDC, the angled-cylinder and the offset-crankshaft design techniques both produce a piston device with identical piston 23, cylinder 22, connecting rod 26, and throw 30 component relationships. The difference between these two design techniques involves which components of a traditional or existing design will be altered to achieve the desired result. Therefore, going forward, this design technique will be referred to as the angled-cylinder design, as when considering only the basic components involved, it is a more generic description.

As previously disclosed, the angled-cylinder technique can be applied to engines, gas compressors and liquid pumps. FIGS. 1 & 2 illustrate the angled-cylinder technique applied to an engine or motor, either internal combustion such as a gasoline or diesel engine, or external combustion such as a steam engine. The throw 30, and the crankpin 28 are represented in an alternate position of the operating cycle, 39 and 31 repectively. In the case of an engine, this position would be 90° past top-dead-center of a 360° clockwise crankshaft 28,30,33 rotation. As illustrated in FIGS. 12 and 13, in the case of a gas compressor or liquid pump, this position, 74 and 72 repectively, would be 270° past top-dead center of a 360° clockwise crankshaft 28,30,33 rotation.

DETAILED DESCRIPTION-FIGS. 1, 2, 3, 4, 12 and 13

First Embodiment

FIGS. 1, 2, 12 and 13 share all the same components. The unique technique I used to measure the torque and performance gains offered by the angled-cylinder piston device employed the use of a hobby-grade steam engine. The reasons for choosing this device were as follows:

1. Steam engines are typically built with open architecture lower ends. The crankshaft and connecting rod assemblies are not enclosed within a crankcase, and therefore they are exposed for easy experimentation.

2. The cylinder and piston assemblies of the steam engine used are constructed as individual components, and then mounted to a plate. The plate is then mounted to the lower assembly by means of machined posts. Adding a system of shims to these posts was a simple procedure, thus creating an assembly that could easily produce variable cylinder angles.

3. Steam engines are external combustion engines, and lend themselves to simple modifications that allow them to operate on controlled compressed air. This was critical, as my intention was to identify the performance gains offered by the angled-cylinder technique, without considerations of heat dissipation and accumulation, combustion gas expansion variations due to a multitude of factors, friction increases and decreases, and other variables related to combustion engines that could distort my observations. The modified steam engine allowed me to run tests that isolated the performance and torque gains inherent in the mechanical advantage of the angled-cylinder technique.

The test engine was assembled with the above mentioned modifications. The output shaft was fitted with a cogged-belt pulley that allowed coupling to an electric generator, also fitted with a cogged pulley, and joined with a cogged belt. The engine's pulley was also marked to allow engine revolutions-per-minute (RPM) readings to be made with an optical tachometer. Extensive tests were conducted, and the results were consistent. FIG. 3 is a chart of typical test results produced when voltage readings were taken at various cylinder angles. FIG. 4 is a chart of typical test results produced when RPM readings were taken at various cylinder angles.

Measuring the amount of modification in terms of cylinder angle became futile, as the small adjustments necessary became too difficult to gauge accurately when measured as cylinder angle. Therefore, I developed the more precise technique of measuring this configuration in terms of the intersection between the cylinder's centerline 37 with the length of throw's centerline 36, 38 FIGS. 1, 2, 12 and 13. A traditional piston device would have its cylinder 22 oriented in a manner such that its centerline 37 would be drawn directly through the piston pivot center axis 25, and the crankshaft main axis 34. In the case of an engine or motor, using the throw 30 positioned at 90° of a clockwise crankshaft rotation 39, and measuring from the crankshaft main center axis 34 to the crankpin center axis 32, a cylinder oriented in such a manner as to have its centerline 37 intersect with throw's centerline 36 can have its orientation calibrated in terms of a percentage of the length of throw centerline 36, 38. Going forward, this measurement will be referred to as cylinder centerline to length of throw centerline intersect 45. This method of determining cylinder orientation can be effectively used when designing either an angled-cylinder, or an offset-crankshaft piston device.

What these tests allowed me to conclude are as follows:

1. The configuration of the cylinder centerline with the length of throw centerline intersect 45 is extremely critical. Very minute changes to the cylinder angle produces measurable changes in torque and performance.

2. The performance and torque gains that can be gleaned from the angled-cylinder technique are not linear. During testing, as the cylinder's centerlines 37 were oriented away from the crankshaft main axis 34 and towards the crankpin center axis position held at 90° of a clockwise rotation 32, the gains were rather small until I approached a cylinder centerline to throw centerline intersect 45 of 30%. The gains then increased exponentially until reaching a throw centerline intersect 45 of 45%, and then began to decrease. Gains in performance rapidly decreased after reaching a cylinder centerline to throw centerline intersect 45 of 49%. It is within the range of a cylinder centerline to throw centerline intersect 45 of 30% to 49% that performance increases of 15% or more can be realized, and this range of cylinder 22 orientation is within the scope of the present embodiment.

DETAILED DESCRIPTION-FIGS. 1, 2, 5, 12 and 13

Second Embodiment

FIGS. 1, 2, 12, and 13 share all the same components. Piston devices designed to operate with a cylinder centerline to throw centerline intersect 45 of 33% to 46% present certain challenges. FIG. 5, reference 48, illustrates a limitation that would be presented when applying this technique to traditional or existing designs. The increased swing of the connecting rod 47 opposite the direction of cylinder angle or cylinder offset can cause an interference between the connecting rod 26 and the bottom of the piston 23. This interference can also occur with the connecting rod 26, and the bottom of the cylinder 22. Another problem created by the exaggerated connecting rod swing 47 is the increase in friction between the piston 23 and the cylinder sidewall 22 as the piston travels from bottom dead center to top dead center in the case of an engine or motor, and from top dead center to bottom dead center in the case of a compressor or pump. A solution to these problems provided by this embodiment, is to balance the amount of cylinder centerline to throw centerline intersect 45 with the degree of interference and/or friction increases, which is in direct proportion to the devices connecting rod-to-stroke ratio. The amount of cylinder centerline to throw centerline intersect 45 is determined by assessing the connecting rod/stroke ratio, and selecting one of three classes:

CLASS 1—This class determines a specific cylinder centerline to length of throw intersect 45. A piston device with a connecting rod/stroke ratio of less than 1.5/1 respectively presents a greater amount of interference and increased frictions, and therefore permits a lower amount of cylinder angle. Accordingly, a cylinder centerline to length of throw centerline intersect 45 of 33% is determined. In the case of a compressor or pump, a tolerance of +/- 3% of length of throw 38 is determined, and in the case of an engine or motor, a tolerance of +/- 2.5% of length of throw 38 is determined.

CLASS 2—This class also determines a specific cylinder centerline to length of throw intersect. A piston device with a connecting rod/stroke ratio of greater than 1.9/1 respectively presents a lesser amount of interference and friction increases, and therefore permits a greater amount of cylinder angle. Accordingly, a cylinder centerline to length of throw centerline in-tersect 45 of 46% is determined. In the case of a compressor or pump, a tolerance of +/- 3% of length of throw 38 is determined, and in the case of an engine or motor, a tolerance of +/- 2.5% of length of throw 38 is determined. Piston engines or motors with connecting rod/stroke ratios greater than 4/1 are outside the scope of this embodiment.

CLASS 3—This class determines a sliding amount of cylinder centerline to throw centerline intersect 45. Piston devices with connecting rod/stroke ratios between 1.5/1 to 1.9/1 would have the cylinder centerline to length of throw centerline intersect 45 determined proportionally from 33% to 46% respectively, including the above stated tolerances.

The tolerances are to allow for other device characteristics such as connecting rod 26 width, or piston 23 diameter, and in the case of an engine or motor, expansion of components due to higher operating temperatures is considered.

This selection process provides the optimum amount of cylinder centerline to length of throw centerline intersect 45 as a function of the connecting rod/stroke ratio.

This method of determining optimum cylinder centerline 37 orientation is within the scope of the present embodiment.

DETAILED DESCRIPTION-FIGS. 5 and 6

Third Embodiment

Another concern when designing an angled-cylinder piston device is the interference between the connecting rod 26 and the piston's 23 base, also known as the piston skirt 75, as shown in FIG. 5, reference 48. The piston skirt FIG. 6, reference 75 is a functional structure normally required to keep the piston 23 parallel within the cylinder 22 as it transits past TDC and BDC of the crankshaft's 28, 30, 33, 360° rotational cycle 35. A solution to this issue provided by this embodiment is the recessed piston 46 as shown in FIG. 6. An area of relief 51 formed at the base or skirt of the piston 46, and oriented in a manner to accommodate the swing of the connecting rod 26, will provide clearance for the free operation of the connecting rod 26 throughout the crankshaft's 28,30,33 360° rotational cycle 35. This method of overcoming mechanical interferences in the angled-cylinder piston device is within the scope of the present embodiment.

DETAILED DESCRIPTION-FIGS. 5, 6 and 7

Fourth Embodiment

Another concern when designing an angled-cylinder piston device is the interference between the connecting rod 26 and the cylinder's 22 base, as shown in FIG. 5, reference 48. A solution to this issue provided by this embodiment is the recessed cylinder sleeve 53 as shown in FIG. 7. A sleeve inserted into a cylinder's bore 52, and having an area of relief 55 that is oriented in a manner to accommodate the swing of the connecting rod 26, will provide clearance for the free operation of the connecting rod 26 throughout the crankshaft's 360° rotational cycle 35. This sleeve design is very effective, as piston devices designed using the angled-cylinder technique would require extremely accurate relationships between the piston rings 50, and the area of relief 55 in the sleeve. Therefore, providing such an area of relief formed in a bored block would be challenging in the manufacturing process. A sleeve designed as described could be held in the cylinder's bore 52 either mechanically or through some bonding means, but would require some mechanical or bonding means to keep it from rotating within the cylinder bore 52. A misalignment between the connecting rod 26 and the area of relief 55 would lead to failure. This method of overcoming mechanical interferences in the angled-cylinder piston device is within the scope of the present embodiment.

DETAILED DESCRIPTION-FIGS. 8, 9, and 10

Fifth Embodiment

A designer of an angled-cylinder piston device wishing to avoid re-designing as many peripheral components as possible may take the approach of angling the cylinder 22 about the piston pivot 24 location at TDC in the original design. This design technique would avoid having to re-design the cylinder heads 21, but would create a condition of excess cylinder volume 57 when the piston 23 is positioned at TDC, as shown in FIG. 8. A solution to this problem is to design a piston 59 whose top 60 is formed in such a manner as to compensate for this excess volume 57, as shown in FIGS. 9 and 10. This solution may prevent the re-designing of many other internal and external components as well. This method of overcoming insufficient compression in the angled-cylinder piston device is within the scope of the present embodiment.

DETAILED DESCRIPTION-FIGS. 5 and 11

Sixth Embodiment

Another concern when designing an angled-cylinder piston device is the increase in friction between the piston 23 and the cylinder 22 wall as shown in FIG. 5, reference 49. This increase in friction occurs as the piston 23 travels from BDC to TDC of the crankshaft 360° rotational cycle 35 in piston engines or motors, and from TDC to BDC in Piston compressors or pumps. If the piston device is centrally lubricated, a lubrication passage 67 formed in the connecting rod 26, and oriented in such a manner as to tap the central lubrication supply and apply additional lubrication to the affected area 49 of the cylinder's 22 wall as shown in FIG. 11, would solve this issue. The movement of the connecting rod 26 as the crankpin 28 travels from BDC to TDC, or TDC to BDC would provide excellent lubrication distribution. A lubrication passage properly formed in the crankshaft 28,30,33 would provide the same benefit. This method of overcoming insufficient lubrication in the angled-cylinder piston device is within the scope of the present embodiment.

Thus the scope of the embodiments should be determined by the appended claims, and their legal equivalents, rather than by the examples given.

DRAWINGS

Figures

DRAWINGS

Reference Numerals

Figure 1:
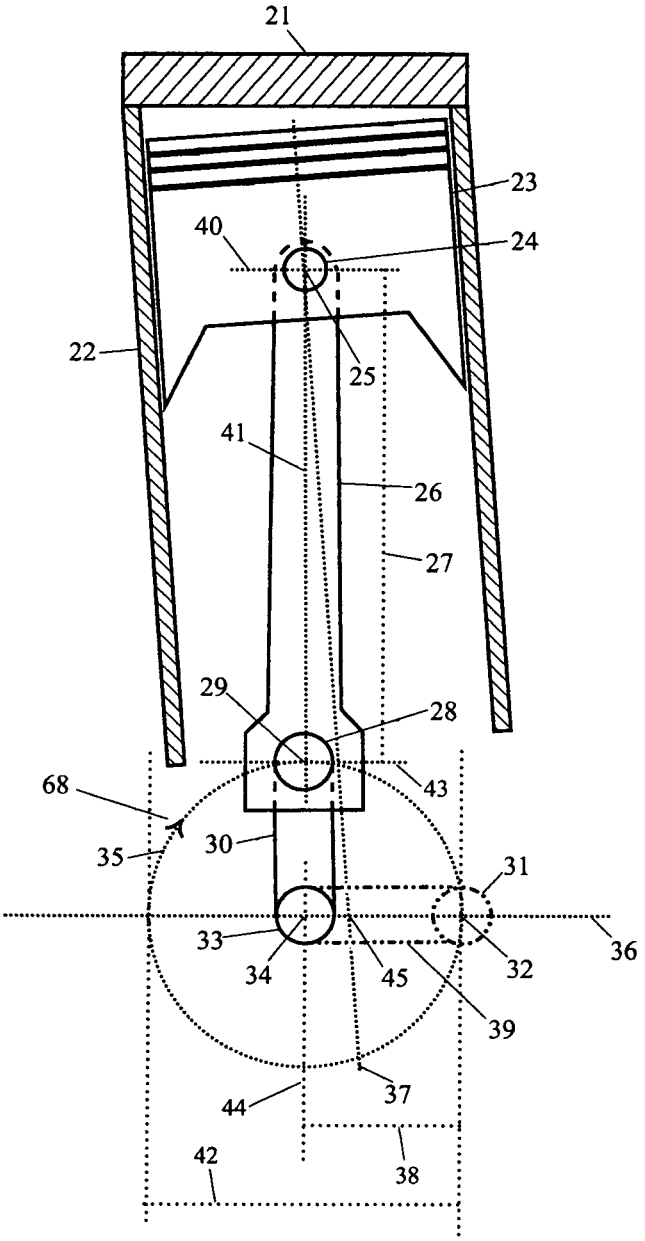
FIG. 1 shows a cross section of a cylinder, piston and crankshaft assembly which is an example of an angled-cylinder piston engine or motor configuration with the crankshaft positioned at top-dead-center. Also, an alternate position of the crankpin with the crankshaft positioned at 90° past top dead center of a clockwise rotation is shown.
Figure 2:
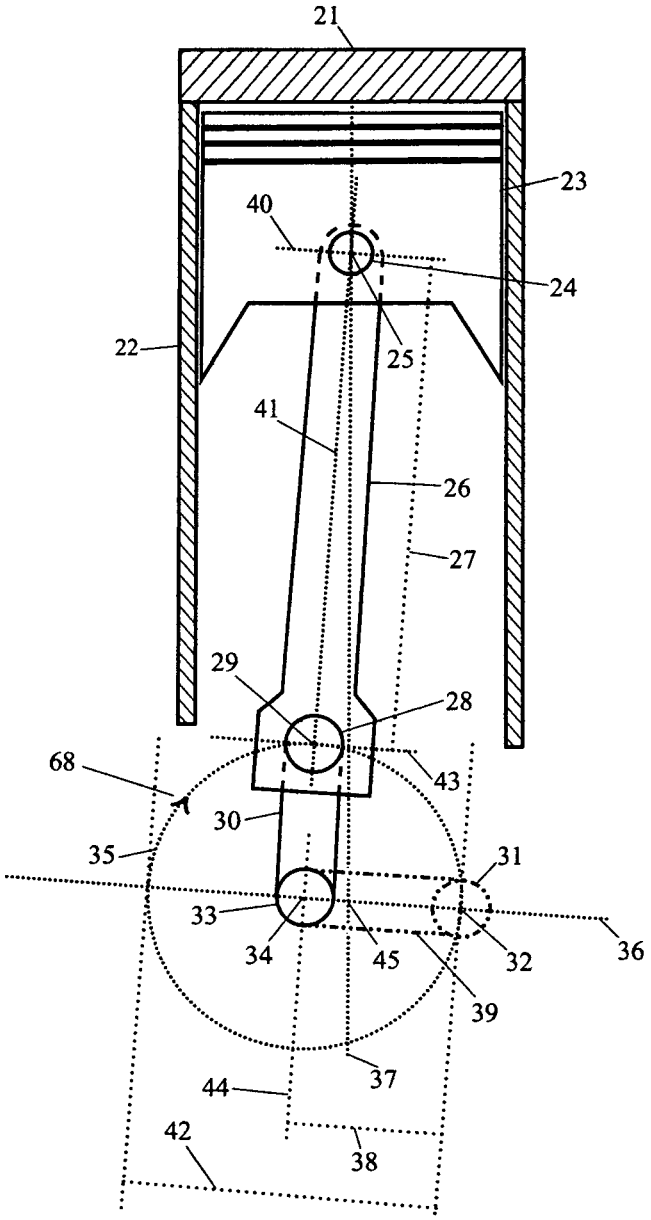
FIG. 2 shows a cross section of a cylinder, piston and crankshaft assembly which is an example of an offset-crankshaft, or offset-cylinder engine or motor configuration with the crankshaft positioned at top dead center. Also, an alternate position of the crankpin with the crankshaft positioned at 90° past top dead center of a clockwise rotation is shown.
Figure 3:
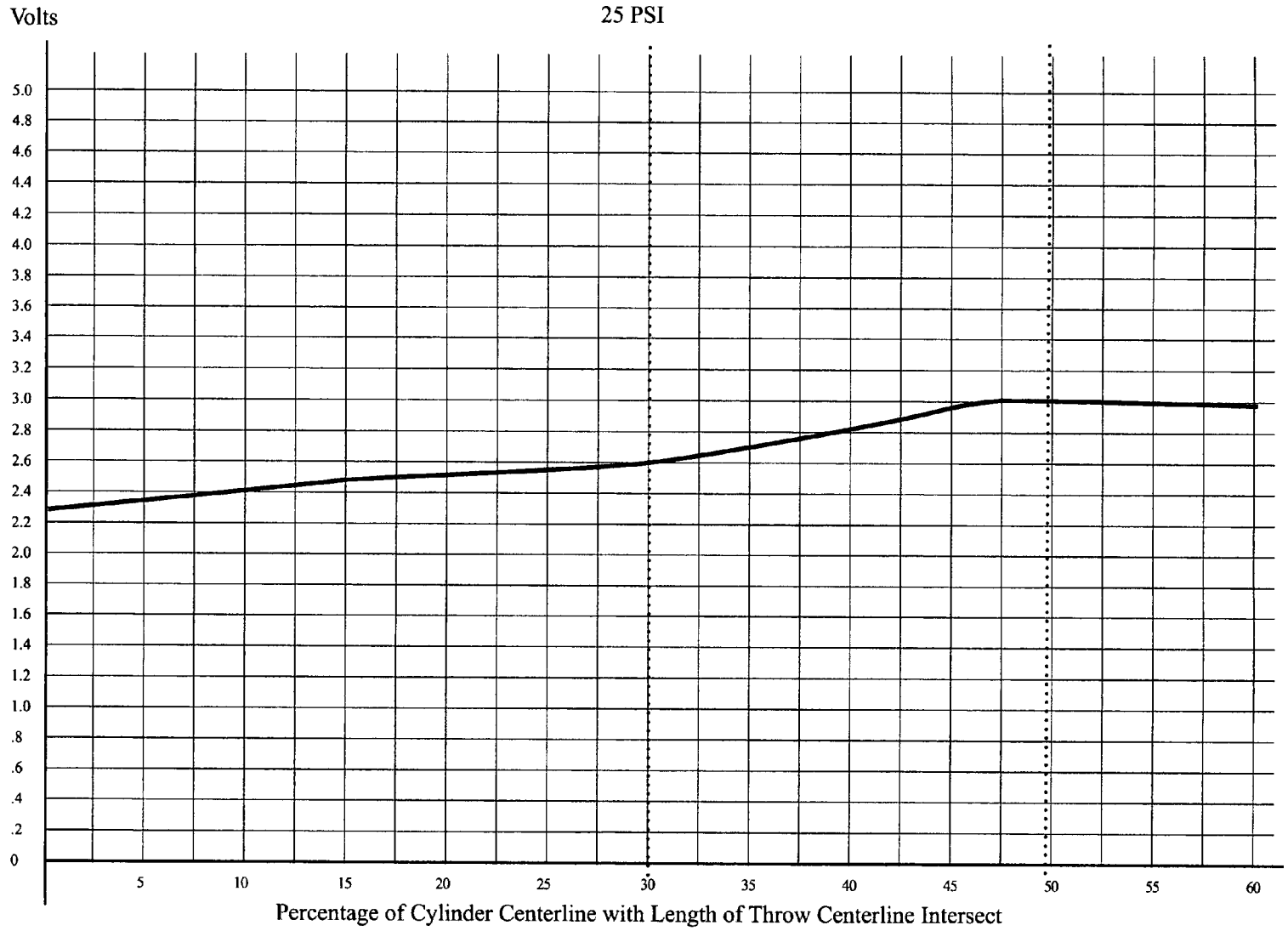
Figure 4:
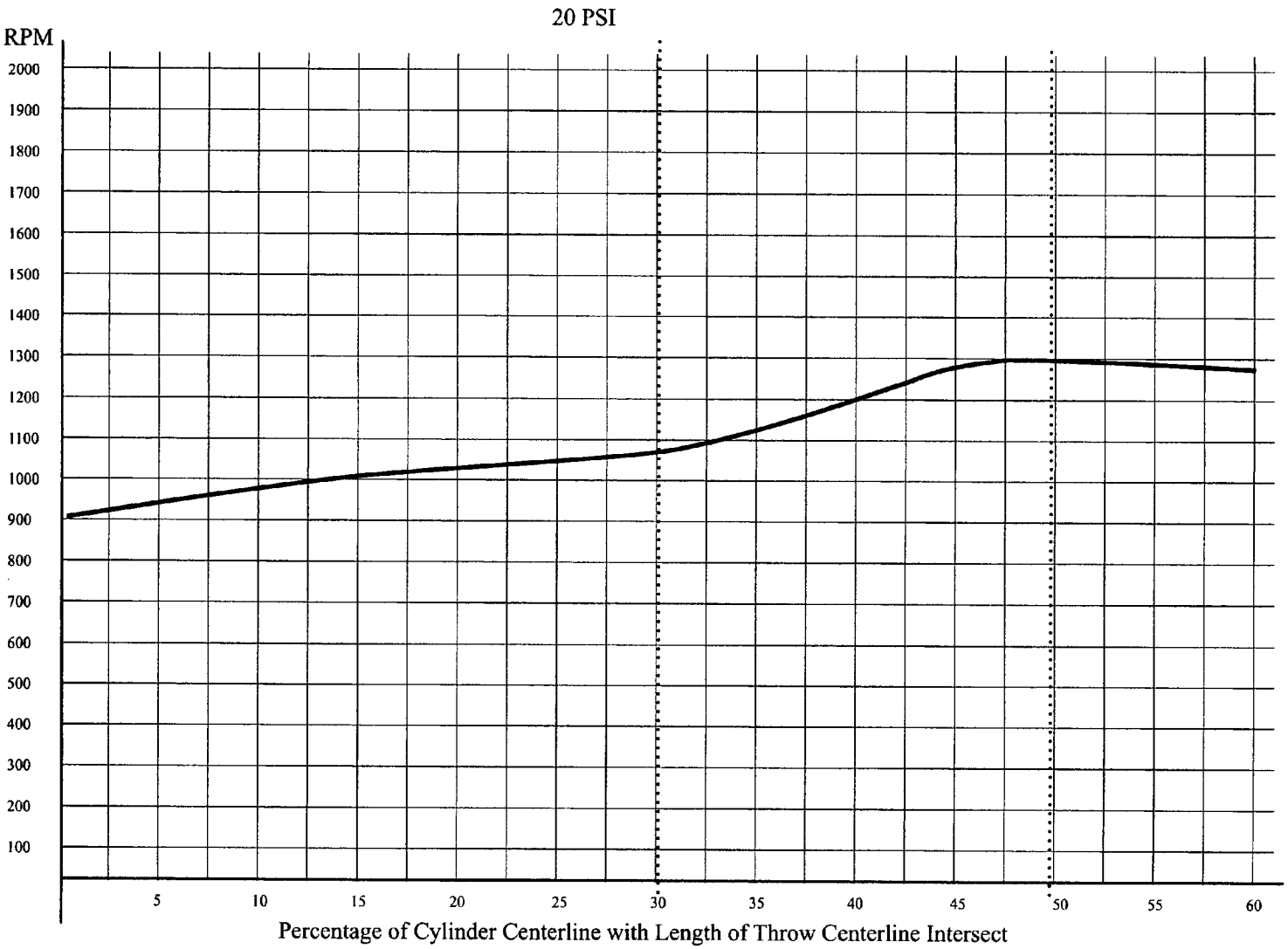
Figure 5:
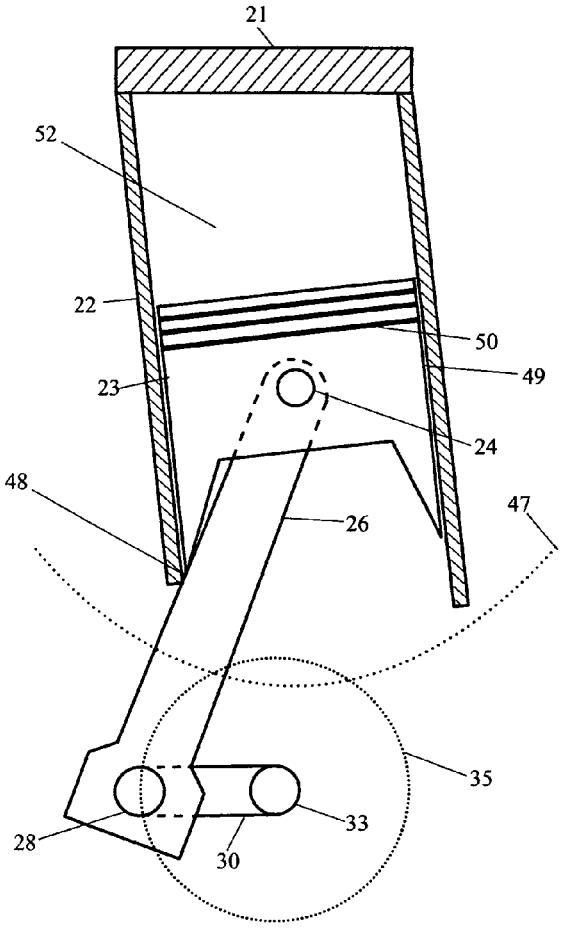
Figure 6:
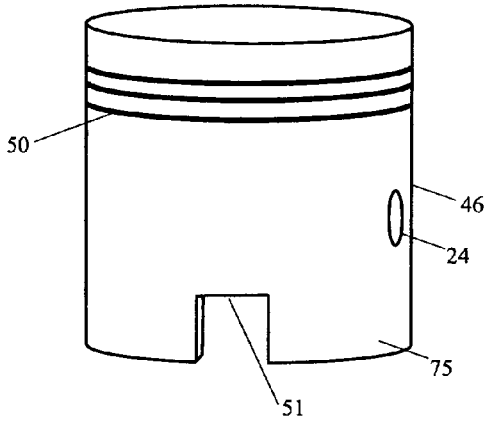
FIG. 6 shows an example of a recessed piston with an area of relief.
Figure 7:
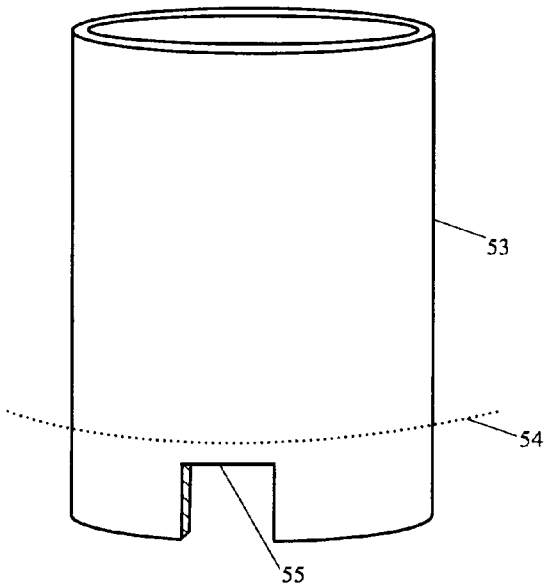
FIG. 7 shows an example of a recessed cylinder insert sleeve with an area of relief.
Figure 8:
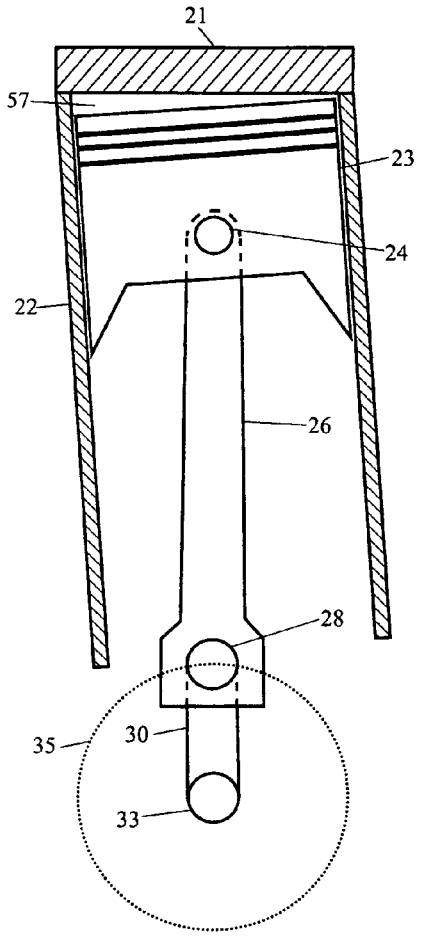
FIG. 8 shows an angled-cylinder piston device with the crankshaft positioned at top dead center. This figure shows the excess volume of the cylinder chamber at top dead center.
Figure 9:
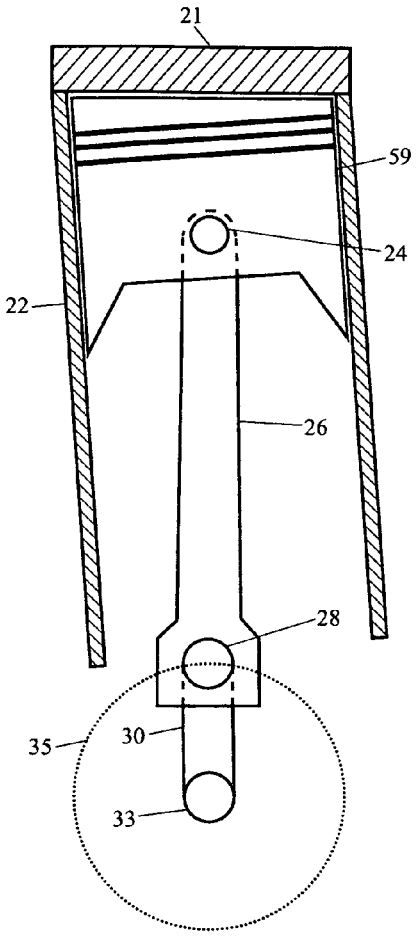
FIG. 9 shows an angled-cylinder piston device with the crankshaft positioned at top dead center. This figure shows the excess volume of the cylinder chamber at top dead center corrected with a compensating piston.
Figure 10:
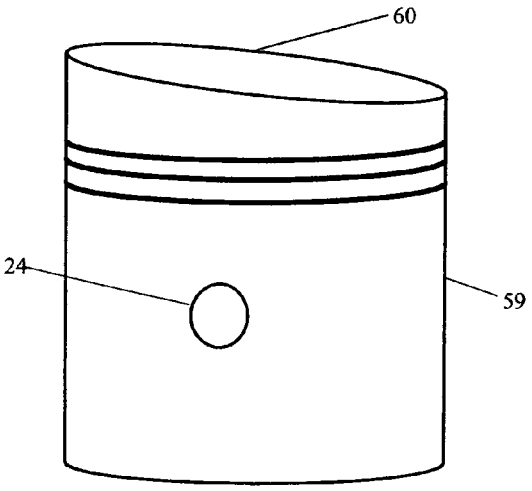
FIG. 10 shows an example of a compensating piston.
Figure 11:
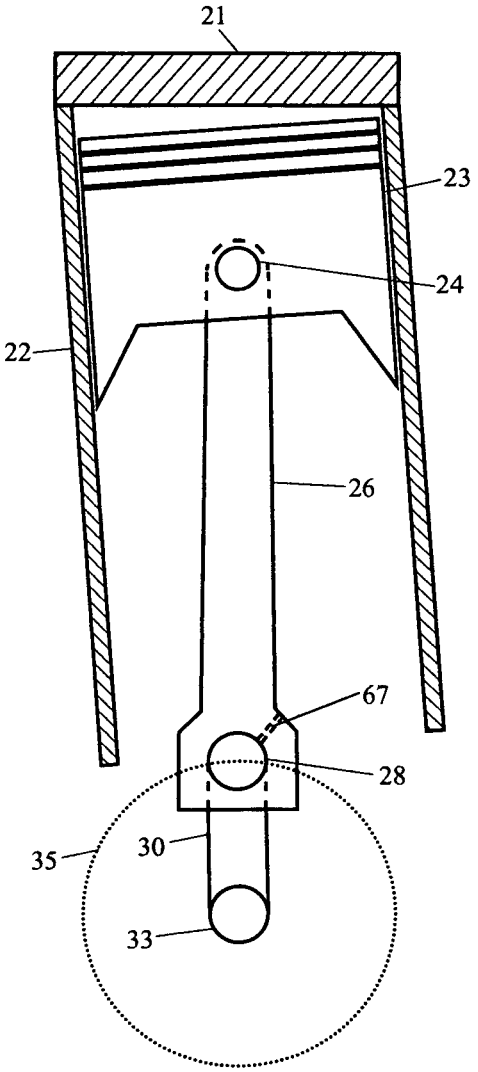
FIG. 11 shows an example of an angled-cylinder piston device with an additional lubrication passage.
Figure 12:
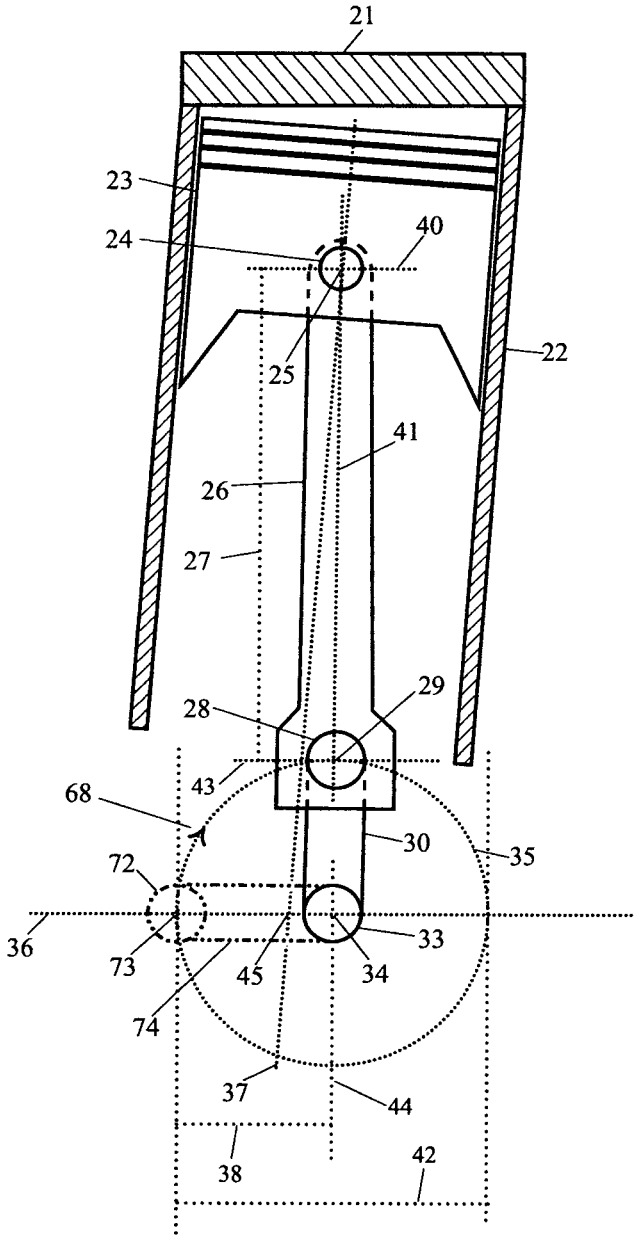
FIG. 12 shows a cross section of a cylinder, piston and crankshaft assembly which is an example of an angled-cylinder piston pump or compressor configuration with the crankshaft positioned at top dead center. Also, an alternate position of the crankpin with the crankshaft positioned at 270° past top dead center of a clockwise rotation is shown.
Figure 13:
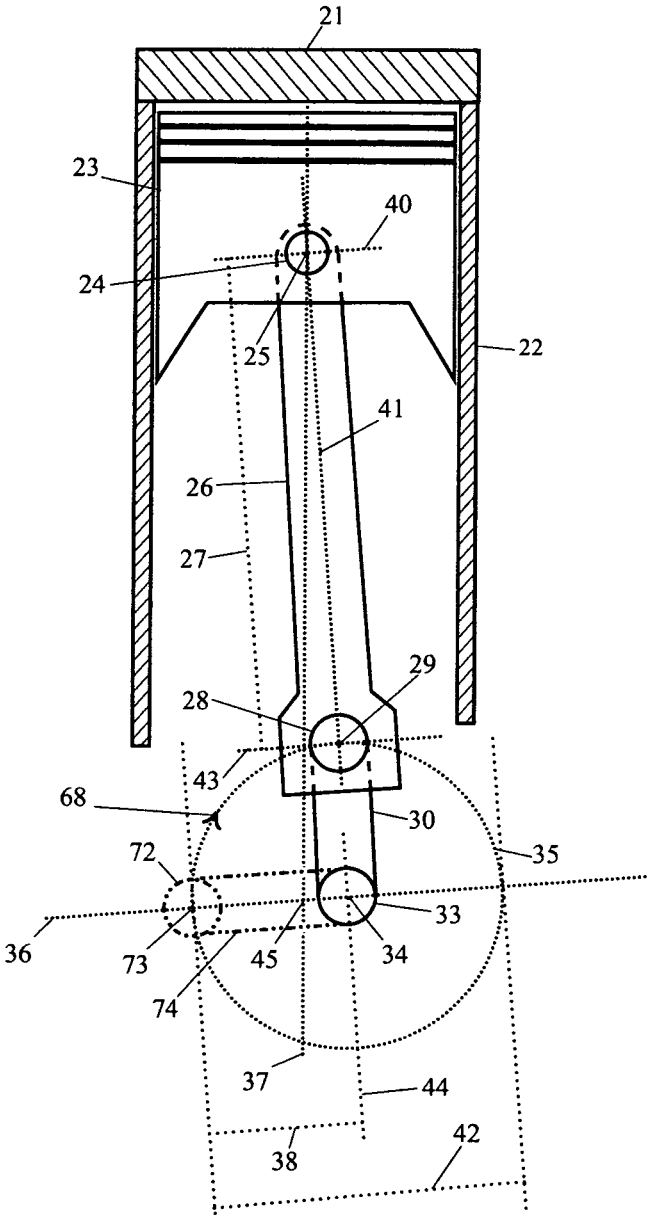
FIG. 13 shows a cross section of a cylinder, piston and crankshaft assembly which is an example of an offset crankshaft, or offset cylinder piston pump or compressor configuration with the crankshaft positioned at top dead center. Also, an alternate position of the crankpin with the crankshaft positioned at 270° past top dead center of a clockwise rotation is shown.

21 cylinder head
22 cylinder
23 piston
24 piston pivot
25 piston pivot center axis
26 connecting rod
27 length of connecting rod
28 crankpin
37 centerline of cylinder
29 crankpin center axis
30 throw
31 crankpin position at 90° past top dead center of a clockwise crankshaft rotation
32 crankpin center axis position at 90° past top dead center of a clockwise crankshaft rotation
33 crankshaft main journal
34 crankshaft main axis
35 stroke path of crankpin center axis
36 throw centerline location at 90° past top dead center of a clockwise crankshaft rotation
37 centerline of cylinder
38 length of throw
39 throw position at 90° past top dead center of a clockwise crankshaft rotation
40 piston pivot horizontal centerline
41 connecting rod centerline
42 stroke diameter

43 crankpin horizontal centerline
44 crankshaft main axis vertical centerline
45 cylinder centerline with length of throw centerline intersect
46 recessed piston
47 connecting rod swing
48 point of interference
49 point of increased friction
50 piston rings
51 piston bottom area of relief
52 cylinder bore
53 recessed cylinder sleeve
54 location of cylinder bore bottom
55 cylinder sleeve area of relief
57 area of excess cylinder volume
59 compensating piston
60 compensating piston top
67 lubrication passage
68 indicates direction of rotational operation of crankshaft
72 crankpin position at 270° past top dead center of a clockwise crankshaft rotation
73 crankpin center axis position at 270° past top dead center of a clockwise crankshaft rotation
74 throw position at 270° past top dead center of a clockwise crankshaft rotation
75 piston shirt

I claim:

1. A method for determining the optimum orientation for a cylinder or cylinders of an angled cylinder, an offset crankshaft or an offset cylinder piston engine or motor comprising the steps of;

a. determine a length of connecting rod measured from a piston axis of pivot to a crankpin axis of rotation;
b. determine a length stroke by multiplying by 2 a length of throw measured from a crankshaft axis of rotation to said crankpin axis of rotation;
c. determine a connecting rod to stroke ratio by dividing the said length of connecting rod by said length of stroke;
d. evaluating the said connecting rod to stroke ratio to ascertain the selection of one of three classes;
e. wherein said connecting rod to stroke ratio is in the range of 4 to 1 respectively to 1.9 to 1 respectively, and wherein said crankshaft is positioned at 90° of an operational rotation past a position of top dead center, an intersect of an imaginary centerline of said cylinder intersects with an imaginary centerline of said throw at 46% of said length of throw measured from said crankshaft axis of rotation to said crankpin axis of rotation, with a tolerance of +/−2.5% of said length of throw, a said optimum cylinder orientation is thereby determined;
f. wherein said connecting rod to stroke ratio is in the amount less than 1.5 to 1 respectively, and wherein said crankshaft is positioned at 90° of said operational rotation past said position of top dead center, said intersect of said imaginary centerline of said cylinder intersects with said imaginary centerline of said throw at 33% of said length of throw measured from said crankshaft axis of rotation to said crankpin axis of rotation, with a tolerance of +/−2.5% of said length of throw, a said optimum cylinder orientation is thereby determined and
g. wherein said connecting rod to stroke ratio is in the range of 1.5 to 1 respectively to 1.9 to 1 respectively, and wherein said crankshaft is positioned at 90° of said operational rotation past said position of top dead center, said intersect of said imaginary centerline of said cylinder intersects with said imaginary centerline of said throw is in the range of 33% to 46% of said length of throw respectively, measured from said crankshaft axis of rotation to said crankpin axis of rotation and thereby determined proportionally, with a tolerance of +/−2.5% of said length of throw, a said optimum cylinder orientation is thereby determined.

2. A method of efficient manufacturing process that provides clearance for an operational swing of a connecting rod of an angled cylinder, an offset crankshaft, or an offset cylinder piston engine or motor of at least one cylinder as described in claim 1 comprising the steps of;

a. casting or fabricating a block to contain at least one said cylinder;
b. fabricating or constructing at least one tubular cylinder liner or sleeve;
c. forming an area of relief on said liner or sleeve;
d. inserting said liner or sleeve into said cylinder, orienting said area of relief in such a manner as to provide clearance for the said operational swing of said connecting rod and
e. fixing said liner or sleeve to said cylinder by either a mechanical or a bonding means.

3. A method of efficient design for overcoming an insufficient compression condition in an angled cylinder, an offset crankshaft, or an offset cylinder piston engine or motor of at least one cylinder as described in claim 1 comprising the steps of;

a. fabricating or constructing at least one piston having a top whose general plane is not perpendicular to an imaginary centerline of said cylinder and
b. incorporating said piston in said cylinder and the operation of said piston engine or motor.

4. A method of overcoming a mechanical interference condition in an angled cylinder, an offset crankshaft, or an offset cylinder piston engine or motor of at least one cylinder as described in claim 1 comprising the steps of;

a. fabricating or constructing at least one piston having a structure formed opposite from said piston top or face and extending past the axis of a connecting rod pivot;
b. forming an area of relief in said structure of said piston and
c. incorporating said piston in said cylinder and an operation of said piston engine or motor with said area of relief oriented in such a manner as to provide clearance to accommodate the swing of a connecting rod throughout the 360° rotational sequence of a crankshaft of said piston engine or motor.

5. A method of overcoming an increased piston to cylinder wall friction in an angled cylinder, an offset crankshaft, or an offset cylinder piston engine or motor of at least one cylinder as described in claim 1 incorporating a central lubrication system comprising the steps of;

a. forming at least one lubrication passage in at least one connecting rod, a crankshaft, or an assembly thereof;
b. orienting said passage in such a manner as to tap said central lubrication system and
c. orienting said passage in such a manner as to provide lubrication, or additional lubrication to said cylinder wall.

6. A method for determining the optimum orientation for a cylinder or cylinders of an angled cylinder, an offset crankshaft or an offset cylinder piston pump or compressor comprising the steps of;

a. determine a length of connecting rod measured from a piston axis of pivot to a crankpin axis of rotation;
b. determine a length of stroke by multiplying by 2 a length of throw measured from a crankshaft axis of rotation to said crankpin axis of rotation;

c. determine a connecting rod to stroke ratio by dividing the said length of connecting rod by said length of stroke;

d. evaluating the said connecting rod to stroke ratio to ascertain the selection of one of three classes;

e. wherein said connecting rod to stroke ratio is in the amount greater than 1.9 to 1 respectively, and wherein said crankshaft is positioned at 270° of an operational rotation past a position of top dead center, an intersect of an imaginary centerline of said cylinder intersects with an imaginary centerline of said throw at 46% of said length of throw measured from said crankshaft axis of rotation to said crankpin axis of rotation, with a tolerance of +/−3% of said length of throw, a said optimum cylinder orientation is thereby determined;

f. wherein said connecting rod to stroke ratio is in the amount less than 1.5 to 1 respectively, and wherein said crankshaft is positioned at 270° of said operational rotation past said position of top dead center, said intersect of said imaginary centerline of said cylinder intersects with said imaginary centerline of said throw at 33% of said length of throw measured from said crankshaft axis of rotation to said crankpin axis of rotation, with a tolerance of +/−3% of said length of throw, a said optimum cylinder orientation is thereby determined and g. wherein said connecting rod to stroke ratio is in the range of 1.5 to 1 respectively to 1.9 to 1 respectively, and wherein said crankshaft is positioned at 270° of said operational rotation past said position of top dead center, said intersect of said imaginary centerline of said cylinder intersects with said imaginary centerline of said throw is in the range of 33% to 46% of said length of throw respectively, measured from said crankshaft axis of rotation to said crankpin axis of rotation and thereby determined proportionally, with a tolerance of +/−3% of said length of throw, a said optimum cylinder orientation is thereby determined.

7. A method of efficient manufacturing process that provides clearance for an operational swing of a connecting rod of an angled cylinder, an offset crankshaft, or an offset cylinder piston pump or compressor of at least one cylinder as described in claim 6 comprising the steps of;

a. casting or fabricating a block to contain at least one said cylinder;

b. fabricating or constructing at least one tubular cylinder liner or sleeve;

c. forming an area of relief on said liner or sleeve;

d. inserting said liner or sleeve into said cylinder, orienting said area of relief in such a manner as to provide clearance for the said operational swing of said connecting rod and e. fixing said liner or sleeve to said cylinder by either a mechanical or a bonding means.

8. A method of efficient design for overcoming an insufficient compression condition in an angled cylinder, an offset crankshaft, or an offset cylinder piston pump or compressor of at least one cylinder as described in claim 6 comprising the steps of;

a. fabricating or constructing at least one piston having a top whose general plane would not be perpendicular to an imaginary centerline of said cylinder and b. incorporating said piston in said cylinder and the operation of said piston pump or compressor.

9. A method of overcoming a mechanical interference condition in an angled cylinder, an offset crankshaft, or an offset cylinder piston pump or compressor of at least one cylinder as described in claim 6 comprising the steps of;

a. fabricating or constructing at least one piston having a structure formed opposite from said piston top or face and extending past the axis of a connecting rod pivot;

b. forming an area of relief in said structure of said piston and c. incorporating said piston in said cylinder and an operation of said piston pump or compressor with said area of relief oriented in such a manner as to provide clearance to accommodate the swing of a connecting rod throughout the 360° rotational sequence of a crankshaft of said pump or compressor.

10. A method of overcoming an increased piston to cylinder wall friction in an angled cylinder, an offset crankshaft, or an offset cylinder piston pump or compressor of at least one cylinder as described in claim 6 and incorporating a central lubrication system comprising the steps of;

a. forming at least one lubrication passage in at least one connecting rod, a crankshaft, or an assembly thereof;

b. orienting said passage in such a manner as to tap said central lubrication system and c. orienting said passage in such a manner as to provide lubrication, or additional lubrication to said cylinder wall.

11. A piston pump or compressor designed using the method described in claim 7.

12. A piston pump or compressor designed using the method described in claim 8.

13. A piston pump or compressor designed using the method described in claim 9.

14. A piston pump or compressor designed using the method described in claim 10.

15. A piston engine or motor designed using the method described in claim 1.

16. A piston pump or compressor designed using the method described in claim 6.

17. A piston engine or motor designed using the method described in claim 2.

18. A piston engine or motor designed using the method described in claim 3.

19. A piston engine or motor, designed using the method described in claim 4.

20. A piston engine or motor designed using the method described in claim 5.

* * * * *